United States Patent [19]

Mukai et al.

[11] 3,974,976

[45] Aug. 17, 1976

[54] APPARATUS FOR SUPPRESSING ROTATIONAL FLUCTUATION OF SUPPLY ROLL

[75] Inventors: Hideo Mukai; Toshiaki Yamaguchi, both of Kyoto; Tsuneo Yoshida, Tokyo, all of Japan

[73] Assignee: Nishimura Seisakusho Co., Ltd., Kyoto, Japan

[22] Filed: June 24, 1974

[21] Appl. No.: 482,627

[30] Foreign Application Priority Data

June 26, 1973 Japan ..... 48-76275

[52] U.S. Cl. ..... 242/75.5

[51] Int. Cl.[2] ..... B65H 23/20

[58] Field of Search ..... 242/75.5, 75.1, 75, 242/75.43, 75.51, 75.52, 75.53, 75.4, 75.47

[56] References Cited

UNITED STATES PATENTS

| | | | |
|---|---|---|---|
| 2,392,226 | 1/1946 | Butterworth et al. | 242/75.5 |
| 2,883,122 | 4/1959 | Bowen | 242/75.5 |
| 2,916,227 | 12/1959 | Bowen | 242/75.5 |
| 2,937,819 | 5/1960 | Bowen | 242/75.5 |
| 3,145,945 | 8/1964 | Bowen | 242/75.5 X |
| 3,239,161 | 3/1966 | Dutro et al. | 242/75.1 |
| 3,297,273 | 1/1967 | Ippolito | 242/75.5 |

*Primary Examiner*—Stanley M. Gilreath
*Assistant Examiner*—John M. Jillions
*Attorney, Agent, or Firm*—Morgan, Finnegan, Pine, Foley & Lee

[57] ABSTRACT

An apparatus for suppressing the rotational fluctuation of a supply roll includes a drive source and a differential gear. The drive source is operatively connected to the first input shaft of the differential gear and a support shaft for the supply roll is operatively connected to the second input shaft via a variable speed gear. The output shaft is joined to both a hydraulic coupling and a control for the variable speed gear. A high frequency fluctuation of the rotation of the supply roll causes a forward or reverse rotation of the output shaft of the differential gear. The hydraulic coupling acts to retard the output shaft rotation thereby causing a braking or driving force to be applied through the differential gear to the supply roll for eliminating the rotational fluctuation of the supply roll. The variable speed gear functions to keep the second input shaft of the differential gear to rotate at a fixed average speed while the average rotational speed of the supply roll continues to gradually increase as the roll diameter is reduced with the progress of the unrolling operation.

14 Claims, 8 Drawing Figures

APPARATUS FOR SUPPRESSING ROTATIONAL FLUCTUATION OF SUPPLY ROLL

BACKGROUND OF THE INVENTION

This invention relates to apparatus for controlling the rotational fluctuation of supply rolls. In particular, this invention relates to an apparatus for suppressing high frequency rotational fluctuations which are generated when unrolling the supply rolls of web materials having an adhesive applied thereto such as adhesive tapes, films and the like.

The web materials having an adhesive applied on at least one surface thereof such as adhesive tapes or films are generally wound up into rolls for ease of handling and storage. These rolls are called "the supply roll". In order to use or consume the adhesive tape, it must be stripped away from the supply roll. In industrial applications, the stripping of the adhesive tape from the supply roll is automatically carried out by various unrolling machines. Although the unrolling operation of the adhesive tape roll by the conventional machines is efficient and generally satisfactory, some operational problems remain to be solved. One of the most important of these, for example, is that the rotation of the supply roll fluctuates peripherally at relatively high frequencies while the adhesive tape is being stripped away from the roll by an unwinding force at a substantially fixed speed. The high frequency peripheral or rotational fluctuation of the supply roll while being rotated by the unrolling force is believed to be caused primarily due to the fact that the peel off resistance against the unrolling of the tape which is produced by the adhesion between the tape surfaces in the roll changes during the unrolling operation. Further, once a cycle of such peripheral or rotational fluctuation is initiated it tends to continue through the entire operation. If the supply roll fluctuates in the peripheral direction at a relatively high frequency during rotation, then the length of the adhesive tape being stripped away goes through a vigorous flapping with the tension applied thereto widely changing. At the same time, objectionable flapping and peel-off noises are generated. For a smooth and acceptable unrolling of the supply roll, in particular of the adhesive web materials, it is highly desired to eliminate the high frequency rotational fluctuations of the supply roll.

BRIEF SUMMARY OF THE INVENTION

It is therefore a general object of this invention to provide an apparatus for controlling the rotation of the rolls of web materials while such materials are pulled out from the rolls.

It is a more specific object of this invention to provide an apparatus for suppressing the fluctuations in the rotation of the rolls of adhesive webs such as tapes, films or the like while they are stripped away from the rolls.

It is another object of this invention to provide an improved machine for stripping away adhesive web materials from the supply rolls without causing rotational fluctuation of the rolls.

The above and further objects and features of the invention will more fully appear from the following detailed description when the same is read in connection with the accompanying drawing. It is to be expressly understood, however, that the drawing is for purpose of illustration only and is not intended as a definition of the limits of the invention.

According to this invention, there is provided an apparatus for suppressing a relatively high frequency rotational fluctuation of a supply roll containing a length of an adhesive film or the like, the apparatus including a drive source and a differential gear. The differential gear has first and second input shafts and an output shaft. The first input shaft is operatively connected to the drive source, while the second input source is operatively connected to a support shaft for the supply roll of the adhesive tape. The output shaft is joined to the input of a suitable hydraulic coupling means, the output thereof being fixed against rotation. The adhesive tape is adapted to be stripped away from the supply roll at a substantially fixed speed causing the supply roll, and thus the support shaft therefor, to rotate freely. If the rotation of the supply roll fluctuates at a relatively higher frequency, the fluctuating rotation is carried to the second input shaft of the differential gear and is compared to the substantially constant rotation of the first input shaft driven by the drive source. Any difference in the rotational speeds between the first and second input shafts appears on the output shaft of the differential gear as a forward or reverse rotation thereof depending upon whether the second input rotation is higher or lower than the first input shaft rotation. With the output shaft of the differential gear being connected to the hydraulic coupling and with the output shaft of the hydraulic coupling being stationary or fixed, a rotation of the output shaft of the differential gear is countered by the viscosity resistance of a fluid in the coupling acts as a braking force on the output shaft. As a result, due to the operating nature of the differential gear, either the same braking force is applied to the roll support shaft to lower the rotation of the supply roll or the rotative force of the first input shaft rotation is imparted to the roll support shaft to raise the rotation of the supply roll. In this manner, the fluctuations in the rotational speed of the supply roll are effectively controlled by the cooperation of the differential gear and the hydraulic coupling, thus enabling the supply roll to rotate steadily and smoothly while the adhesive tape is being stripped away from the roll. As the roll diameter is reduced with the progress of the unrolling operation, the average rotational speed of the roll is gradually increased. In order to compensate for the rise of the average rotational speed, a variable speed gear means is provided between the support shaft and the second input shaft of the differential gear and operates to reduce the average rotation of the support shaft close to that of the first input shaft.

According further to this invention, there is provided an improved machine for stripping an adhesive web material from a supply roll while controlling the fluctuation of the supply roll rotation to a minimum. The machine includes, in addition to the fluctuation control apparatus as described above, at least one roller which is rotated at a substantially fixed speed by the drive source of the apparatus and functions to continuously strip the adhesive tape away from the supply roll and deliver it to a subsequent processing location.

DETAILED DESCRIPTION OF THE PREFERRED EMBODIMENT OF THE INVENTION

Figure 2:
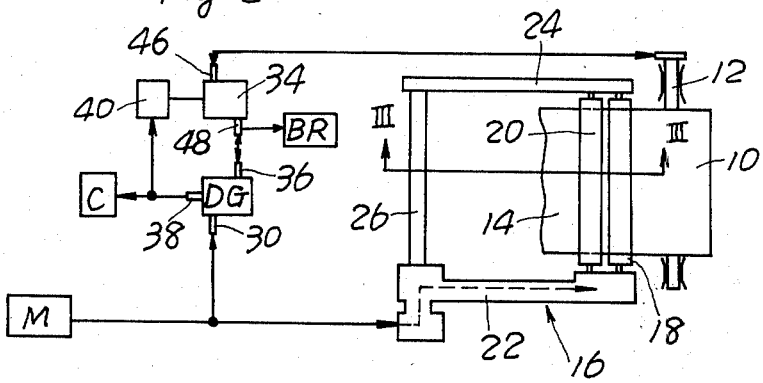
FIG. 2 is a diagrammatic illustration of an unrolling machine having incorporated therein the apparatus for suppressing the rotational fluctuations of the supply roll according to this invention.
Figure 3:
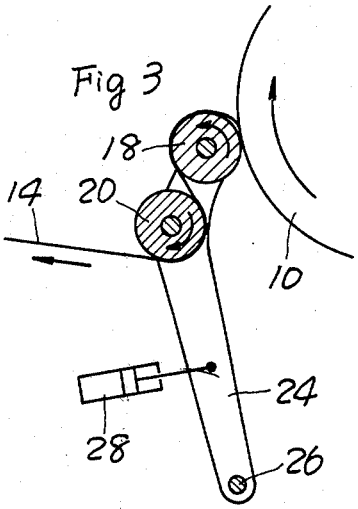
FIG. 3 is a fragmental cross-sectional view taken on line III—III of FIG. 2.

Referring now to the accompanying drawings and in particular to FIG. 2, there is schematically illustrated an apparatus for suppressing rotational fluctuations of a supply roll according to one preferred embodiment of the invention. As shown, a supply roll 10 of a thin adhesive tape, film or the like of a suitable width is fixedly supported on a rotary shaft 12 for rotation therewith when the adhesive tape 14 is being unrolled or stripped away from the roll. The unrolling of the adhesive tape from the supply roll 10 is carried out by a take-out mechanism generally indicated by the reference numeral 16. As illustrated in FIGS. 2 and 3, the take-out mechanism 16 comprises a pair of elongated rollers 18 and 20 which are rotatably mounted between a pair of support arms 22 and 24. The support arms are disposed to extend generally radially toward the supply roll 10 and are connected together by a connecting rod 26 for pivotal movement on a stationary structure (not shown) of the apparatus. The pair of rollers 18 and 20 are rotatably supported between the free end portions of the arms 22 and 24 in a spaced, parallel relation. As hereinbelow explained in detail, the length of the adhesive tape 14, as it is being unrolled from the supply roll, passes first over the roller 18 on one side of the roller axes and then over another roller 20 on the other side of the axes (see FIG. 3). The upper roller 18 which is disposed closer to the supply roll 10 functions to peel the adhesive tape 14 off the supply roll, while the lower roller 20 which is disposed away from the supply roll functions to positively take out and deliver the peeled off tape towards a subsequent processing station or location (not shown). In order to bring the peel-off roller 18 in slight pressure contact or out of contact with the supply roll 10, an air cylinder 28 is connected to one of the support arms in the illustrated apparatus to the arm 24 at a location intermediate the pivot rod 26 and the free end of the arm. With this arrangement, actuation of the air cylinder 28 in one direction moves the support arms 22 and 24 clockwise about the pivot rod 26 as seen in FIG. 3 to bring the peel-off roller 18 into pressure contact with the supply roll 10, and, upon actuation in the other direction, the cylinder moves the support arms counter-clockwise thereby to bring the peel-off roller away from the supply roll.

In order to peel off the adhesive tape away from the supply roll, it is necessary to drive the rollers 18 and 20 preferably at a constant speed. Thus, in the illustrated embodiment, a motor M is provided as a driving source and is operatively connected via a suitable driving mechanism to the rollers 18 and 20. As the motor M is energized, it drives the rollers at a substantially constant rotational speed to pull out the adhesive tape 14 from the supply roll 10 while causing a simultaneous rotation of the supply roll and thus the rotary shaft 12. As shown in the schematic illustration of FIG. 2, the output of the driving motor M is also connected to the first input shaft 30 of a differential gear DG, and the rotary shaft 12 is connected via a variable-speed gear 34 to the second input shaft 36 of the differential gear DG. As can be readily understood by those skilled in the art, the differential gear DG further includes an output shaft 38 and any difference in rotational speed between the first and second input shafts causes a corresponding rotational movement of the output shaft 38 in either direction. In other words, if the rotation of the second input shaft 36 exceeds or falls below that of the first input shaft 30 which is driven by the motor M at a substantially fixed speed, the difference of rotation between the two input shafts appears on the output shaft 38 in terms of a forward or reverse rotation depending upon whether the second input shaft rotation is lower or higher than the first input shaft rotation. The output shaft 38 of the differential gear DG is in turn linked to the input end of a suitable hydraulic coupling C. The output end of the hydraulic coupling C is fixed against rotation so that a viscosity resistance of the fluid in the coupling may act via the input end as a braking force on the output shaft of the differential gear DG. With this arrangement, as the output shaft rotates in either direction a force is applied to the output shaft which acts to counter the rotation thereof. It should be noted at this point that, if the rotation of the output shaft 38 is transmitted to the hydraulic coupling C after being amplified by a suitable variable speed means, even a small hydraulic coupling may produce a large braking force.

The output shaft of the differential gear DG is also connected to a control 40 for the variable-speed gear 34. The purpose of the variable-speed gear control 40 is to change the transmission ratio of the variable-speed gear in relation to the prolonged rotation of the output shaft 38 of the differential gear DG in such a manner as to permit a free, increased rotation of the rotary shaft 12 as the roll diameter of the supply roll 10 is being gradually reduced with the progress of the unrolling operation. This point will be explained in more detail hereinbelow.

In operation, the motor M is energized to rotate the peel-off and take-out rollers 18 and 20 at a substantially fixed speed and the air cylinder 28 is actuated to urge the support arms 22 and 24 clockwise about the pivot axis 26 so that the peel-off roller makes a slight pressure contact on the periphery of the supply roll 10. The rollers 18 and 20 continuously peel off the length of the adhesive tape 14 from the supply roll and deliver it in the direction of the arrow toward the subsequent processing location, thus effecting the unrolling of the supply roll. As can be understood, the adhesive tape has an adhesive applied on at least one surface thereof and, for ease of handling and storage, the length of such tape is generally wound up into a roll with the adhesive applied surface facing inside toward the axis of the roll. Thus, in the rolled-up state, the adhesive applied surface of the tape in each turn of the roll remains peelably attached to the non-adhesive surface of the tape in inner adjacent turn of the roll. The rolling out of the adhesive tape from the supply roll is carried out by the rollers 18 and 20 of the tape-out mechanism against the above-mentioned peelable attachement of the adhesive applied surface to the non-adhesive surface of the tape. In other words, the sticking of the adhesive surface to the non-adhesive of the tape acts to oppose the peeling off the length of the adhesive tape away from the supply roll by the rollers 18 and 20. This opposing force against the peeling-off is termed herein as "a peel-off resistance". As long as the adhesive material is applied over one surface of the tape along its entire length, which is true in most cases, the unrolling of the adhesive tape is continued by the take-out mechanisms 16 against the peel-off resistance. However, the peel-off resistance is not necessarily constant in actual operation due to the fact that the adhesion between the adhesive applied and non-adhesive surfaces of the tape in adjacent turns of the supply roll is not uniform along the entire length of the tape. Factors contributing to the nonuniform adhesion along the length of the rolled-up, adhesive tape are many. For example, during winding up into a roll, air may have been trapped between the adjacent roll turns of the tape forming small bubbles therebetween at different points along the length, or the tape may have been fed out under irregular tension resulting in an irregular peelable adhesion between the adhesive-applied and non-adhesive surfaces of the rolled-up tape along its length. Moisture penetrating between the adjacent turns of the adhesive tape during the rolling-up or storage also causes the nonuniform peelable adhesion. The nonuniform adhesion results in nonuniform peel-off resistance acting against the take-out mechanism when the length of the tape is being stripped away from the roll at a substantially fixed speed.

Figure 1A:
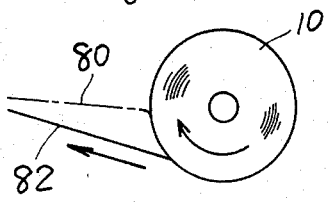
FIGS. 1A and 1B are end views of a roll of an adhesive tape showing the manner in which the fluctuation of the rotational movement of the roll is caused while the tape is being stripped away.
Figure 1B:
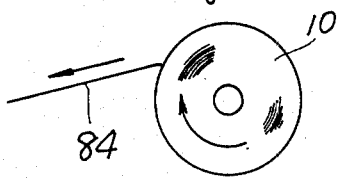

Undesirable influences on the unrolling operation caused by the nonuniform peel-off resistance are now explained having particular reference to FIGS. 1A and 1B. Assuming that the adhesive tape is rolled out from the supply roll 10 at a substantially fixed speed, the tape is supposed to be stripped off along the path indicated at 80 under a normal operating condition. However, if the peel-off resistance is abruptly reduced during unrolling, the adhesive tape tends to be stripped away from the roll along the lower path indicated at 82 since the tape is more readily stripped at lower peel-off resistances. It should be noted that the change over of the strip-off path from the normal path 80 down to the lower path 82 causes a corresponding abrupt decrease in the rotational speed of the supply roll. At this point, if the peel-off resistance increases, it becomes harder to strip off the tape from the supply roll so that the tape is carried upward with the rotating supply roll until it is stripped away, for example via an upper path indicated at 84. During this change over of the strip-off path from the lower path to the upper path, the rotational speed of the supply roll temporarily increases. Again at this point, if the peel-off resistance decreases, then the tape is readily and quickly stripped away and the strip-off path moves abruptly toward the lower path 82 during which time the rotation of the supply roll is brought to a temporary halt or is suddenly retarded. This up and down movement of the strip-off path is frequently repeated as the adhesive tape is being pulled off the supply roll, causing frequent fluctuations of the rotational movement of the supply roll. In short, the supply roll fluctuates back and forth in the peripheral direction at relatively high frequencies according to the variations of the peel-off resistance, even if the adhesive tape is stripped away at a substantially fixed speed. Moreover, once a cycle of the peripheral back and forth motion or the rotational fluctuation of the supply roll is initiated then it tends to continue through the entire unrolling operation. The frequent rotational fluctuation has undesirable influences on the unrolling operation in that it applies varying tension on the adhesive tape which is being pulled out from the roll, and that it causes the flapping of the rolled out tape with objectionable flapping noises. Thus, it is highly desirable to suppress the rotational fluctuation of the supply roll so that the supply roll may rotate smoothly and steadily without the rotational fluctuation.

According to this invention, the rotation of the shaft 12, and thus of the supply roll 10 is transmitted to the second input shaft 36 of the differential gear DG via the variable-speed gear 34 and is compared with the rotation of the drive motor M which is conveyed to the first input shaft 30 of the differential gear. As explained above, the drive motor M rotates at a substantially constant speed to provide "a reference rotation". If, in operation, the high frequency fluctuation of the supply roll rotation occurs and the rotational speed of the supply roll 10 abruptly decreases to such an extent to bring the rotation of the second input shaft 36 of the differential gear below that of the first input shaft due to a reduced peel off resistance then the minus deviation of the second input shaft rotation from the first input shaft rotation or reference rotation appears on the output shaft 38 of the differential gear DG in terms of a forward rotation of the output shaft, the degree of the rotation being dependent on the degree of the rotational deviation. The larger the deviation, the greater the rotational movement of the output shaft. The forward rotation of the output shaft, however, is retarded by the viscosity resistance of the fluid in the hydraulic coupling C, the input of which is connected the output shaft. As the rotational movement of the output shaft 38 is retarded by the hydraulic coupling, the rotation of the first input shaft 30 is transmitted directly via the second input shaft 36 to the rotary shaft 12 due to the operating nature of the differential gear DG. This transmission of the first input rotation to the rotary shaft provides a driving force thereto which acts to counter the abrupt reduction of the rotational speed of the supply roll 10. In short, as the result of the retarding action of the hydraulic coupling C on the forward rotation of the output shaft 38, the rotational force of the motor M is conveyed via the differential gear DG to the rotary shaft 12 as a driving force to counteract the lowering rotational movement of the supply roll. On the other hand, if the rotational speed of the supply roll suddenly increases due to an increased peel off resistance to such an extent as to raise the rotation of the second input shaft 36 relative to that of the first input shaft 30, the plus deviation of the second input shaft rotation from the first input shaft rotation appears on the output shaft 38 of the differential gear in terms of a reverse rotation thereof. The reverse rotation of the output shaft is similarly retarded by the viscosity resistance of the fluid in the hydraulic coupling C. In this case, however, with the first input shaft 30 being driven at a constant reference speed, the retarding force applied by the coupling on the output shaft 38 is conveyed via the second input shaft 36 to the rotary shaft 12 and counteracts the accelerating rotation of the supply roll 10. In this manner, the rotational fluctuation of the supply roll is effectively suppressed to a minimum through the application of the driving and retarding forces to the rotary shaft 12 by the unique combination of the differential gear and the hydraulic coupling. The stable, fluctuation free rotation of the roll is thus assured. It should be noted that, due to the operational characteristic of the hydraulic coupling C, the apparatus of the invention exhibits a better control over the rotational fluctuations of a greater amplitude and a higher frequency. The position of the peel-off roller 18 relative to the supply roll 10 also has something to do with the fluctuation controlling function of the present apparatus and better results are obtained by keeping the peel-off roller in contact with the periphery of the supply roll during the unrolling operation.

The speed fluctuation of the rotating supply roll caused primarily by the varying peel-off resistance and occuring at a relatively high frequency is effectively suppressed in the above described manner thereby to keep the supply roll rotating steadily and smoothly. However, as briefly stated hereinabove, the average rotational speed of the supply roll itself gradually increases as the roll diameter is reduced with the progress of the unrolling operation. For a smooth and efficient unrolling, this gradual increase of the supply roll rotation must be allowed. Under the fluctuation control by the combination of the differential gear and the hydraulic coupling, this is not necessarily the case. As the average rotational speed of the supply roll 10 increases relative to the average rotational speed of the drive motor M, the hydraulic coupling C continues to apply a braking force to the supply roll via the output shaft 38 and the second input shaft 36 of the differential gear DG in substantially the same manner as described above. The braking force acts to oppose the gradual increase of the average rotational speed of the supply roll with the result that an increased tension is applied continuously to the length of the tape being pulled out from the roll and the smooth and efficient rolling out of the adhesive tape is hampered. In order to avoid this situation, a change in the average rotational speed of the rotary shaft 12 should not be reflected directly to the second input shaft 36 of the differential gear DG. In other words, the rotary shaft must be connected to the second input shaft differential gear in such a manner as to permit the high frequency rotational fluctuation of the supply roll to be carried directly to the second input shaft of the differential gear but to prevent the change in the average rotational speed of the supply roll from being directly carried thereto. For this purpose, the variable-speed gear 34 is provided in combination with the speed gear control 40. Any conventional variable speed gear may be used for the present purpose. However, it is preferred to use a stepless type variable-speed gear as schematically illustrated in FIGS. 4 and 5. The stepless variable-speed gear 34 is operatively connected between the rotary shaft 12 and the second input shaft 36 of the differential gear DG and includes two pairs of conical wheels, an input pair 42 and an output pair 44. The input pair 42 includes a pair of conical wheels 42*a* and 42*b* which are supported on an input shaft 46 with their conical surfaces facing toward each other and for rotation with and a limited axial sliding movement relative to the input shaft 46. The output pair 44 also includes a pair of conical wheels 44*a* and 44*b* and they are similarly supported on an output shaft 48 with their conical surfaces facing toward each other for rotation with and limited axial sliding movement relative to the output shaft 48. A belt or chain 50 is placed around the two pairs of conical wheels and between each pair of the conical wheels for engagement with the conical surfaces thereof. In order to move the conical wheels axially toward and away from each other along each shaft, a suitable linkage is provided. As shown, the linkage includes a first link bar 52 which is pivotally connected to the holders of the conical wheels 42*a* and 44*a*, and a second link bar 54 which is pivotally connected to the holders of the conical wheels 42*b* and 44*b*. The two link bars 52 and 54 are pivotally supported at points intermediate the input and output shafts 46 and 48 by a common support bracket 58. A threaded control rod 60 is screwed into the threaded apertures at one end of the link bars so that the rotation of the control rod 60 moves the apertured ends of the link bars either toward or away from each other.

Figure 4B:
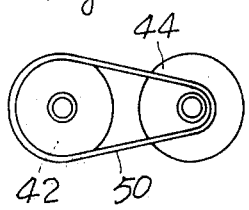
FIG. 4B is a schematic illustration showing the manner in which an input rotation is stepped up into an output rotation of a higher rotational speed by the variable speed gear at the maximum speed setting thereof.
Figure 4A:
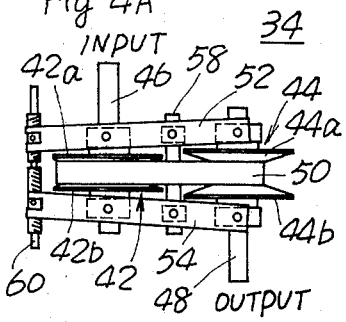
FIG. 4A is a plan view of a variable speed gear incorporated in the apparatus of FIG. 2 showing the component parts thereof being disposed at the maximum speed setting.
Figure 5B:
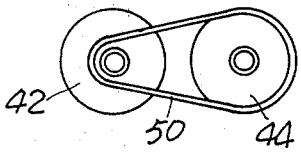
FIG. 5B is a schematic illustration similar to FIG. 4B showing the manner in which an input rotation is stepped down into an output rotation of a lower rotational speed.
Figure 5A:
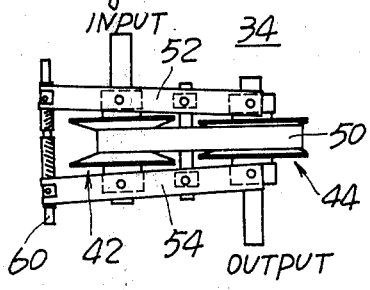
FIG. 5A is a plan view similar to FIG. 4A showing the component parts being disposed at the minimum speed setting.

With this arrangement of the variable-speed gear 34, assuming that the apertured ends of the link bars 52 and 54 are brought together by rotating the threaded control rod 60 in one direction, then the input conical wheels 42*a* and 42*b* are moved axially toward each other while the output conical wheels 44*a* and 44*b* are moved axially away from each other as shown in FIG. 4*A*. In this relative axial position of the conical wheels, the connecting belt 50 makes an operative engagement with the input wheels at their outermost peripheries and with the output wheels at their innermost peripheries as shown in FIG. 4*B*. This is the maximum speed setting where an input rotation is stepped up into an output rotation of a higher speed. Conversely if the threaded control rod 60 is rotated in an opposite direction to bring the apertured ends of the link bars 52 and 54 away from each other as shown in FIG. 5*A*, then the input wheels 42*a* and 42*b* are moved axially away from each other while the output wheels 44*a* and 44*b* are moved axially toward each other. As the result, the connecting belt 50 comes into an operative engagement with the input wheels at their innermost peripheries and with the output wheels at their outermost peripheries as shown in FIG. 5*B*. This is the minimum speed setting where an input rotation is stepped down into an output rotation of a lower speed. Thus, by rotating the control rod 60 in either direction, the transmission ratio of the input rotation to the output rotation is steplessly or continuously adjusted within the range between the maximum setting of FIG. 4*B* and the minimum setting of FIG. 5*B*, the actual setting being dependent on the direction and the degree of the control rod rotation.

In the illustrated apparatus of the invention, the input shaft 46 of the variable-speed gear 34 is operatively connected to the rotary shaft 12 on which the supply roll is mounted, while the output shaft 48 is joined to the second input shaft 36 of the differential gear DG (See FIG. 2). In order to control the variable-gear 34, there is provided the speed gear control 40 in the form of a suitable motion converter which is responsive only to rotation of a relatively long duration. As also shown in FIG. 2, the speed gear control 40 has an input connected to the output shaft 38 of the differential gear DG and an output shaft connected to the control rod 60 of the variable-speed gear 34. With this combination of the variable-speed gear and the speed-gear control, as the average rotational speed of the rotary shaft 12 increases with the progress of the unrolling operation, the increased average rotation is conveyed via the variable-speed gear to the second input shaft 36 of the differential gear and drives the same at a rotational speed higher than that of the first input shaft 30. This causes the reverse rotation of the output shaft 38 which continues for a relatively long period of time. The continued reverse rotation of the output shaft is then fed to the input of the speed-gear control 40 which in turn drives the control rod 60 of the variable-speed gear in the direction to bring the link ends away from each other. As a result, the speed setting of the variable-speed gear 34 is lowered toward the minimum setting of FIG. 5*A* and the rotation of the rotary shaft 12 is applied to the second input shaft 36 after being reduced through the variable-speed gear toward the level of the first input shaft rotation. The reverse is also true in theory but it does not take place in the actual operation of the present apparatus since the adhesive tape is drawn from the supply roll at a fixed speed and the supply roll is kept substantially free to rotate during the unrolling operation. In this manner, any increase in the average rotational speed of the rotary shaft relative to the substantially fixed rotation of the drive motor M is effectively controlled by the cooperation of the variable-speed gear 34 and the speed gear control 40 to keep the average rotation of the second input shaft 36 as close as possible to the first input shaft rotation during the entire rolling out operation. In other words, the variable-speed gear and the speed ratio control cooperate to prevent the change in the average rotational speed of the rotary shaft from being directly applied to the second input shaft of the differential gear. As long as the average rotation of the second input shaft is kept close to the first input shaft rotation, no braking or driving force is imparted back to the rotary shaft 12 by the action of the hydraulic coupling C even if the average rotation of the shaft 12 changes. Thus, the rotary shaft is allowed to rotate at ever increasing speed as the roll diameter is gradually reduced with the progress of the unrolling operation without applying an increased tension on the adhesive tape. It should be recalled that such is the operating nature of the speed gear control 40, it responds only to the prolonged or continued rotation of the output shaft 38 and does not respond to the brief rotation thereof caused by the relatively high frequency rotational fluctuation of the supply roll 10 which is mainly initiated by the changes in the peel-off resistance. In this connection, the phrase "change of the average rotation" is herein used in contrast to "the high frequency rotational fluctuation" of the supply roll.

In the actual version of the apparatus, there is a mechanical loss in the differential gear DG. This mechanical loss causes a greater rotational torque to be applied to the first input shaft 30 by the motor M during operation. The increased torque on the first input shaft is in turn transmitted through the differential gear and the variable speed gear 34 to the rotary shaft 12 to apply a driving force thereto either increasing the driving force or offsetting the braking force imparted to the shaft by the hydraulic coupling C as explained above. This additional driving force is caused continuously during operation independent of the action of the coupling C but is so slight that it exerts no serious detrimental effects on the fluctuation control function of the apparatus except that it causes the tension of the peeled off adhesive tape to increase or decrease slightly by elevating the driving force on or reducing the braking force on the rotating shaft 12. However, it is preferred to avoid the additional driving force being supplied to the rotary shaft 12. For this purpose a suitable brake means BR such as an electromagnetic brake is provided between the second input shaft 36 of the differential gear DG and the output shaft 48 of the variable speed gear 34 and is connected to the output shaft 48. The brake means BR functions to apply a retarding force to the output shaft 46 sufficient to offset or counteract the additional driving force induced by the mechanical loss in the differential gear DG. Thus, the undesirable influences, however slight, caused by the mechanical loss is effectively eliminated by operating the brake BR.

The same braking means BR may also be utilized, if desired, to selectively adjust the tension which is applied to the adhesive tape while being stripped away from the supply roll 10. In this connection, it should be noted that the "tape tension" herein indicates the tension acting on the length of the adhesive tape 14 between the peel-off roll 18 and the take-out roll 20. The tension acting on the portion of the adhesive tape rearward of the take-out roll is determined by and dependent on factors relating to the operation at the subsequent processing location. The output shaft 48 of the variable speed gear 34 being rotated at a substantially fixed average speed, when it is desired to intensify the tape tension, the brake means BR is actuated to such an extent as to apply a braking torque on the shaft 48 in excess of that needed to counter the increased rotational torque which results from the mechanical loss in the differential gear DG. By applying the excess braking torque on the output shaft 48, a retarding force is imparted to the rotary shaft while the adhesive tape is being stripped away from the supply roll at a constant speed. As can be understood by those skilled in the art, the actual tensioning on the adhesive tape is generally dependent on the rotational speed of the supply roll 10 relative to the speed at which the adhesive tape is rolled out as well as the resistance against the tape unrolling. As the retarding force is imparted to the rotary shaft 12 while the tape is being withdrawn at a substantially constant average speed, the tensioning on the adhesive tape 14 between the rollers 18 and 20 increases. In this manner, the tape tension during the unrolling operation may readily be adjusted as desired by actuating the brake means BR.

As herein above described in detail, the unique apparatus of this invention functions to reduce to a minimum the high frequency rotational fluctuations of the supply roll which are mainly initiated during the unrolling operation by the varying peel-off resistance of the adhesive tape. Thus the supply roll is allowed to rotate with the slightest fluctuation assuring that the adhesive tape is rolled out from the supply roll smoothly and steadily. Neither the vigorous and frequent flapping of the adhesive tape nor the violent change of tensioning thereon is produced with the objectionable flapping and peel-off noises during unrolling being substantially reduced.

While the invention has been particularly shown and described with reference to a preferred embodiment, it should be understood by those skilled in the art that various modifications and variations may be made therein without departing from the spirit and scope of the invention. Also the apparatus of this invention may broadly be utilized in applications where it is required to control relative frequency fluctuations of movements.

What we claim is:

1. Apparatus for controlling fluctuations in the rotational movement of a supply roll containing a length of web material while said material is being stripped away from said supply roll, where said material has adhesive provided on at least one of its sides, said apparatus comprising:

roll support means adapted to rotatably support said supply roll for allowing essentially free rotation thereof;

take-out means adapted to contact the periphery of said supply roll for removing said material from said supply roll, said take-out means including:

support means, a peel-off roller rotatably mounted to said support means for contacting the periphery of said supply roll to strip said material from said supply roll and allow said material to become wrapped around a portion of the peripheral surface of said peel-off roller along the side of said material which faces outwardly of the supply roll axis when wound on said supply roll, a take-off roller rotatably mounted to said support means for positioning generally away from said supply roll when said peel-off roller is in contact with said supply roll periphery to take out said material from said peel-off roller, to allow said material to become wrapped around a portion of the peripheral surface of said take-out roller along the side of said material facing inwardly of said supply roll axis when wound on said supply roll, and to deliver said material to a subsequent processing location, means for maintaining said peel-off roll in pressure contact with the periphery of said supply roll, and means for rotating said peel-off and take-out rollers generally at a substantially constant speed;

differential gear means having a first input shaft, a second input shaft and an output shaft, said output shaft adapted to rotate when said first and second input shafts rotate at different speeds;

drive means providing rotational drive substantially at said constant speed, said drive means being operatively coupled to said first input shaft of said differential gear means to provide a reference rotation thereto;

transmitting means coupled to said roll support means for transmitting rotation of said supply roll to said second input shaft of said differential gear means;

resistance means operatively coupled to said output shaft of said differential gear means for suppressing rotation of said output shaft, such that if the rotational speed of said second input shaft of the differential gear means is less than that of said first input shaft, said output shaft rotates in a first direction, said first direction rotation of said output shaft being transmitted to said resistance means for suppression thereof to allow said rotation of said first input shaft to be transmitted via said second input shaft to said supply roll, and if the rotational speed of said second input shaft is greater than that of said first input shaft, said output shaft rotates in a second direction, opposite to said first direction, said second direction rotation of said output shaft being transmitted to said resistance means for suppression thereof to retard the increased rotational speed of said second input shaft and said roll support means.

2. An apparatus according to claim 1 wherein said means for providing a viscosity resistance comprises hydraulic coupling means containing viscous fluid for providing a braking force to said output shaft of said differential gear means.

3. An apparatus according to claim 1 wherein said transmitting means comprises means for changing a transmission ratio.

4. An apparatus according to claim 1 wherein said means for changing a transmission ratio comprises variable speed transmission means.

5. An apparatus according to claim 1 wherein said resistance means comprises means for providing a viscosity resistance to said output shaft.

6. An apparatus according to claim 5 wherein said means for providing a viscosity resistance comprises hydraulic coupling means containing viscous fluid for providing a braking force to said output shaft of said differential gear means.

7. An apparatus according to claim 1 wherein said means for rotating said peel-off and take-out rollers is said drive means.

8. An apparatus according to claim 7 which further includes speed gear control means having its input portion operably coupled to said output shaft of said differential gear means and its output portion operably coupled to said transmitting means, said speed gear control means responding to generally prolonged rotation of said output shaft of said differential gear means for controlling said transmitting means to allow an increase in average rotational speed of said roll due to a decrease in its diameter during the unwinding operation such that said increase in average rotational speed does not induce a braking force to said second input shaft of said differential gear means.

9. An apparatus according to claim 8 wherein said speed gear control means comprises a motion converter essentially responsive only to rotation of generally prolonged duration.

10. An apparatus according to claim 8 wherein said transmitting means comprises a stepless variable-speed transmission which includes:

an input pair of expansive conical wheels rotatably mounted to an input shaft which is operatively coupled to said roll support means;

an output pair of expansive conical wheels rotatably mounted to an output shaft which is operably coupled to said second input shaft of said differential gear means;

endless belt means operatively coupling said input and output pairs of conical wheels along the outer peripheries thereof;

first link means connected to one of said input wheels and one of said output wheels;

second link means connected to the other of said input and output wheels, said first and second link means being adopted to control the position of each of said conical wheels; and, coupling means between said first and second link means to allow control thereof by said speed gear control means for adjusting the axial spacing between said input pair of conical wheels and between said ouput pair of conical wheels to change the speed transmission ratio in order to accommodate increased average rotational speed of said roll.

11. An apparatus according to claim 10 wherein said coupling means comprises a threaded control rod and said first and second link means are provided with means for accommodating threaded rod and said first and second link means comprise first and second link bars pivotally supported at points intermediate of said input and output shafts of said stepless variable-speed transmission by a common support bracket, each link bar being formed at their same ends with means for accommodating said threaded control rod such that said threaded control rod is rotated by said speed gear control means to bring said ends of said link bars together when said average rotational speed increases.

12. An apparatus according to claim 11 which further includes second brake means for applying a braking force to said second input shaft of said differential gear means such that any additional driving force from said drive means and any additional braking force from said resistance means are not imparted to said roll support means.

13. An apparatus according to claim 12 wherein said second brake means comprises an electromagnetic brake.

14. An apparatus according to claim 12 wherein said resistance means comprises means for providing a viscosity resistance to said output shaft of said differential gear means.

* * * * *